US005223180A

United States Patent [19]

Yost

[11] Patent Number: 5,223,180

[45] Date of Patent: Jun. 29, 1993

[54] CARBURETOR FUEL DISCHARGE ASSEMBLY

[76] Inventor: Robert M. Yost, 10838 Olive St. NW., Coon Rapids, Minn. 55448

[21] Appl. No.: 873,840

[22] Filed: Apr. 27, 1992

[51] Int. Cl.[5] ..... F01M 19/03

[52] U.S. Cl. ..... 261/41.1; 261/121.3

[58] Field of Search ..... 261/121.3, 41.1

[56] References Cited

U.S. PATENT DOCUMENTS

| | | | |
|---|---|---|---|
| 1,816,756 | 7/1931 | Whatmough et al. | 261/121.3 |
| 2,127,444 | 8/1938 | Emerson | 261/121.3 |
| 2,273,979 | 2/1942 | Mock | 261/121.3 |
| 4,229,384 | 10/1980 | Karino et al. | 261/121.3 |
| 4,382,047 | 5/1983 | Brown et al. | 261/121.3 |

*Primary Examiner*—Tim Miles

*Attorney, Agent, or Firm*—James W. Miller

[57] ABSTRACT

A butterfly type carburetor has a fuel discharge assembly which is operative during high power conditions only, e.g. during sudden acceleration and/or high speed operations. The fuel discharge assembly includes an elongated, hollow discharge tube having a fuel jet coupled to one end with the other end of the discharge tube being located in the airflow passage of the carburetor. A fuel flow guide tube is inserted into the discharge assembly. The guide tube includes an enlarged head located adjacent the fuel jet to take up any space or pocket formed between that jet and the inlet of the longitudinal bore in the discharge tube. The guide tube also includes a cylindrical body which is telescopically received in the internal bore of the discharge tube and extends at least part of the way up the length of the internal bore from the inlet towards the outlet thereof. The guide tube serves to smoothly conduct fuel from the fuel jet into the internal bore of the discharge tube, thereby promoting better fuel atomization, less turbulence in the fuel stream, and better performance from the engine.

20 Claims, 1 Drawing Sheet

CARBURETOR FUEL DISCHARGE ASSEMBLY

TECHNICAL FIELD

This invention relates to a carburetor for supplying atomized fuel, such as gasoline, to a motor vehicle, such as a motorcycle. More particularly, this invention relates to a butterfly type carburetor having an improved fuel discharge assembly for supplying additional fuel to the carburetor body during high power operating conditions, e.g. during sudden acceleration and/or high speed operation.

BACKGROUND OF THE INVENTION

Carburetors are well known devices for mixing gasoline and air together and for supplying this fuel/air mixture to the combustion chambers of an internal combustion engine. Often, the carburetor is used on the engine powering a motor vehicle, such as an automobile or motorcycle, though carburetors are used on non-vehicular internal combustion engines as well. One traditional carburetor is known as the "butterfly" type. This name comes from the shape of the pivotal throttle plate or throttle valve located inside the carburetor body which somewhat resembles a butterfly. Thus, the throttle plate is also sometimes referred to as the butterfly valve.

A butterfly carburetor includes a carburetor body which is secured to the intake manifold of the engine. The carburetor body includes an airflow passage in which incoming atmospheric air is mixed with fuel prior to being admitted to the intake manifold. The throttle plate is located within and generally at the end of the airflow passage which is closest to the intake manifold. A venturi section in the airflow passage is located upstream of the throttle plate. A first fuel jet is located in or adjacent the venturi section so that air passing through the venturi section will draw fuel out of the first fuel jet to mix such fuel with the air flowing through the venturi section. This mixture of atomized air flows past the throttle plate, through the intake manifold, and into the cylinders of the engine, where it is ignited and burned in a known manner.

The amount of fuel and air admitted into the engine is regulated primarily by the operation of the throttle plate. As the operator steps upon or otherwise actuates the throttle, the throttle plate pivots to a more fully open position, increasing the amount of air flowing through the venturi section which correspondingly increases the amount of fuel being sucked out of the first fuel jet. Conversely, pivoting the throttle plate to a more closed position will decrease the total air flow and fuel being supplied from the first fuel jet, to thereby decrease the engine speed. This operation of the throttle plate is sufficient to adequately supply the engine with fuel during idling and cruising operations of the engine.

However, at certain times, additional power is required from the engine. For example, sudden acceleration and high speed operation of the engine requires more fuel than the pivotal throttle plate and first fuel jet combination described above can provide. Accordingly, some carburetors of this type are also provided with a second fuel jet located in the carburetor body for admitting additional fuel to the airflow passage to enrich the mixture and cause the engine to provide more power.

A butterfly carburetor of the type described above, built in various models, has been manufactured and sold for some time by S&S Cycle for use on motorcycles. For example, S&S has previously manufactured and sold a Super B Gas Carburetor. This carburetor is a butterfly carburetor of the type described above and has both the first fuel jet for idling and cruising conditions and the second fuel jet for acceleration and high speed operations. In the parts materials distributed by S&S relating to this carburetor, the first fuel jet is referred to as the "intermediate jet" and the second or high speed jet is referred to as the "main jet". The main jet is mounted on the end of an elongated cylindrical body, referred to by S&S as the "main discharge tube", which conducts the fuel into the carburetor body. Thus, the main discharge tube and main jet when coupled together form a fuel discharge assembly for high power operations.

In the S&S Super B carburetor just described, the main discharge tube has a threaded boss at one end into which the main jet is threaded to couple the two together. The main discharge tube has an elongated hollow bore extending from the threaded boss all the way through to the other end of the tube. Fuel flows from the main jet into the interior of the discharge tube and through the hollow bore until the fuel is squirted out of the end of the discharge tube. The discharge tube is provided with a line of small holes or openings for admitting air and helping provide proper fuel atomization.

In examining this fuel discharge assembly, the Applicant noticed that the inlet to the hollow bore in the discharge tube is spaced from the main jet by a substantial distance, i.e. by a quarter of an inch or so. Thus, a cylindrical pocket was found by the Applicant to be formed between the outlet end of the main jet and the inlet to the bore of the discharge tube. Applicant felt that such a pocket could possibly allow the fuel to tumble or swirl in the pocket before entering the bore in the discharge tube.

SUMMARY OF THE INVENTION

One aspect of the present invention relates to an improved fuel discharge assembly as described above in which fuel is more smoothly fed from the fuel jet to the internal bore of the discharge tube.

An improved carburetor according to this invention comprises an airflow passage and fuel discharge means for admitting fuel into the airflow passage for mixing the fuel with air flowing in the airflow passage to form a fuel/air mixture to be supplied to the combustion chamber(s) of the engine. The fuel discharge means includes a fuel discharge assembly which comprises a hollow discharge tube and fuel supplying means connected to the discharge tube for admitting fuel into the interior of the discharge tube. The discharge tube has a longitudinal internal bore in fluid communication with the fuel supplying means, and the internal bore extends between an inlet that is closest to the fuel supplying means and an outlet that is furthest from the fuel supplying means with the outlet of the bore being located within the airflow passage of the carburetor to supply fuel into this passage after the fuel passes from the fuel supplying means through the internal bore of the discharge tube. The improvement of the present invention relates to the fuel discharge assembly and comprises a hollow fuel flow guide tube telescopically received inside the internal bore of the discharge tube. The fuel flow guide tube extends from approximately the location of the inlet of the bore up at least a portion of the length of the bore towards the outlet of the bore to conduct fuel from the fuel supplying means into the bore of the discharge tube.

BRIEF DESCRIPTION OF THE DRAWINGS

The present invention will be described hereafter in the Detailed Description, taken in conjunction with the following drawings, in which like reference numerals refer to like elements or parts throughout.

DETAILED DESCRIPTION

Figure 1:
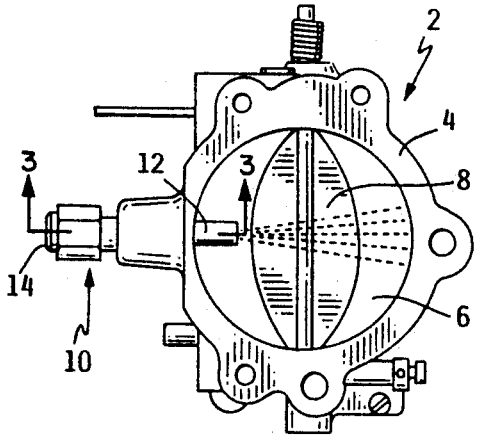
FIG. 1 is a side elevational view of a carburetor of the type to which the present invention relates, illustrating the throttle plate and the fuel discharge assembly used in high power operations.
Figure 6:
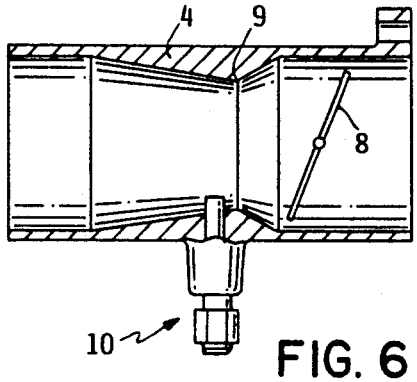
FIG. 6 is a cross-sectional view of a carburetor of the type to which the present invention relates, particularly illustrating the spatial relationship of the fuel discharge assembly of the present invention to the throttle plate and venturi section of the carburetor.

Referring to FIG. 1, a carburetor of the "butterfly" type is generally identified as 2. This carburetor is used on internal combustion engines. Specifically, one carburetor to which the present invention relates is the Super B Gas Carburetor manufactured by S&S Cycle of Viola, Wis. for use on Harley Davidson motorcycles. However, the present invention is not limited for use with this particular carburetor, or to carburetors manufactured only by S&S Cycle, or to carburetors for use only on motorcycles. Rather, this invention would have wide application to any carburetor having a fuel discharge assembly of the type described herein.

Details concerning the structure and operation of butterfly type carburetors are well known to those skilled in the art. Accordingly, the structure and operation of carburetor 2 will be described in this application only insofar as is necessary to an understanding of the present invention.

Referring again to FIG. 1, carburetor 2 includes a carburetor body 4 which is illustrated in FIG. 1 from one end thereof. Carburetor body 4 has a longitudinal airflow passage 6 which is shown in FIG. 1 with its inlet end facing the viewer and its opposite end, being the exit end (i.e. that end of passage 6 which delivers the fuel to the combustion chamber(s) of the engine or an intake manifold connected to such chambers). A pivotal throttle plate 8, also known as the "butterfly valve", is mounted near the outlet end of airflow passage 6. Throttle plate 8 may be pivoted by operation of the throttle from a fully open position where the throttle plate is parallel to the airflow passage 6 to obstruct the passage 6 the least to a fully closed position where the throttle plate extends across passage 6 to completely block or close airflow passage 6. In FIG. 1, throttle plate 8 is shown approximately three quarters open.

Airflow passage 6 includes a restricted venturi section 9 in which a first fuel jet (not shown) is located. In the S&S carburetor referred to above, the first fuel jet is known as the intermediate jet. The air flow passing through the venturi section speeds up in a known manner to create a vacuum that sucks fuel out of the first fuel jet. This fuel is mixed with the airstream and then passes past throttle plate 8 and out of passage 6 to be admitted to the internal combustion engine to which carburetor 2 is attached. The amount of fuel supplied to the engine, and the consequent power and speed developed thereby, is determined by how far throttle plate 8 is open. Opening throttle plate 8 more, rather than less, increases the fuel flow from the first fuel jet, to increase the engine speed. The operation of the first fuel jet is used in idling and cruising operations as discussed in the Background of the Invention Section of this application.

In addition, carburetor 2 includes another fuel discharge assembly generally identified as 10 in the drawings. Fuel discharge assembly 10 supplies additional fuel to airflow passage 6 in carburetor body 4 to enrich the fuel/air mixture when required. This would normally be during sudden acceleration conditions or high speed operation, e.g. operation of the engine above its usual cruising speed. Fuel is sucked out of fuel discharge assembly using the venturi action of the airflow traveling through passage 6 under the above-noted operating conditions of the engine.

Figure 2:
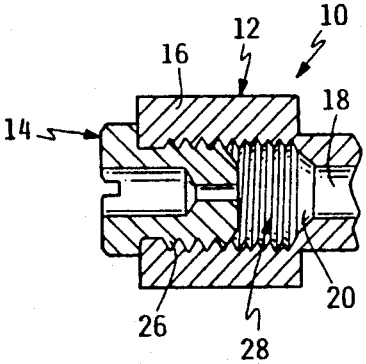
FIG. 2 (PRIOR ART)
FIG. 2 is a partial cross-sectional view of the fuel discharge assembly shown in FIG. 1 as used in prior art carburetors, particularly illustrating the pocket normally formed between the main jet and the inlet to the longitudinal bore in the discharge tube.
Figure 3:
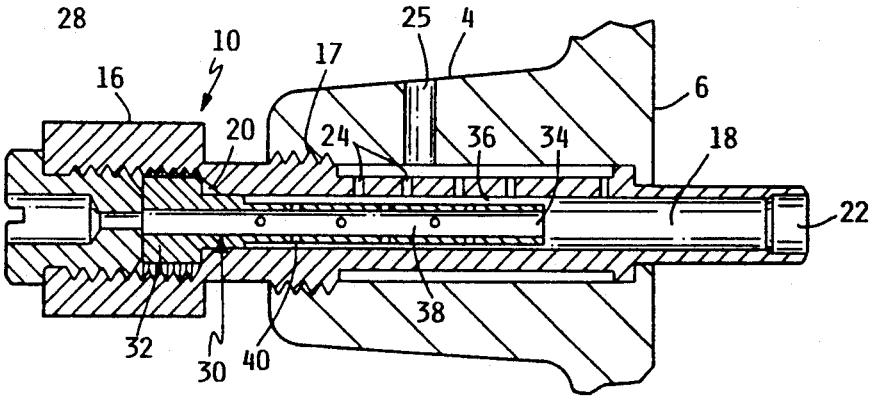
FIG. 3 is a cross-sectional view of the fuel discharge assembly shown in FIG. 1 taken along lines 3-3 in FIG. 1, particularly illustrating the improved fuel discharge assembly of the present invention having a fuel flow guide tube telescopically inserted into the bore of the discharge tube.

Referring to FIGS. 2 and 3, fuel discharge assembly 10 as previously manufactured and supplied in the S&S carburetor includes two components: an elongated discharge tube 12 and a second fuel jet 14. In the S&S carburetor, the discharge tube 12 is referred to as the "main discharge tube" and fuel jet 14 as the "main jet". Discharge tube 12 and fuel jet 14 are coupled together to form one complete fuel discharge assembly 10. During those engine operations when more fuel is required, discharge tube 12 sprays or admits such fuel into airflow passage 6 as shown in FIG. 1.

Discharge tube 12 is generally cylindrical and has an enlarged, internally threaded boss 16 at one end. Tube 12 includes a set of external screw threads 17 to allow tube 12 to be mounted in a portion of carburetor body 4. Tube 12 includes a longitudinal, internal bore 18 extending between an inlet 20 which is adjacent threaded boss 16 and an outlet 22 which forms the free outer end of tube 12. A series of aligned vent holes 24 are provided in tube 12 extending between internal bore 18 and the outside diameter of tube 12. An air bleed passage 25 allows air to reach vent holes 24 and be admitted into tube 12 as fuel flows through tube 12 to help atomize the fuel. Air will be sucked into and through holes 24 by the venturi action of the fuel flowing upwardly through tube 12.

Fuel jet 14 is provided with external screw threads 26 so that it can be threadedly secured with the internal threads provided in threaded boss 16 of tube 12. When so installed as shown in FIG. 2, the prior art fuel discharge assembly 10 has fuel jet 14 spaced from bore inlet 20 by a short distance, thereby creating a pocket illustrated as 28 in FIG. 2. Applicant noticed this pocket and the present invention relates in part to structure for minimizing fuel turbulence or swirl that might be created by the presence of this pocket to enhance overall operation of carburetor 2.

The improvement of the present invention comprises an additional fuel guide tube 30 created by Applicant and added to the preexisting fuel discharge assembly 10 just described. The purpose of fuel guide tube 30 is to conduct fuel from fuel jet 14 smoothly into internal bore 18 of discharge tube 12, thereby avoiding possible fuel turbulence occurring in pocket 30. Fuel guide tube 30 has an enlarged head 32 which is approximately the same size, or slightly smaller, than the width of pocket 28 so as to be received therein. In addition, fuel guide tube 30 includes a cylindrical body 34 which is telescopically received inside internal bore 18 of discharge tube 12. Body 34 has a diameter of approximately .125 inches and is sized to be somewhat smaller in diameter than the inside diameter of discharge tube 12. Thus, an annular space or chamber 36 is formed between fuel guide tube 30 and internal bore 18 in tube 12.

As shown in FIG. 3, fuel guide tube 30 has a length which is smaller than the length of internal bore 18 of tube 12. Fuel guide tube 30 terminates short of outlet 22 of bore 18 and extends over approximately 50% or so of the length of internal bore 18. Guide tube 30 is open at both ends having a fuel flow passageway 38 extending through the entire length of fuel guide tube 30 including through the enlarged head 32 and body 34. Fuel flow passageway 38 in guide tube 30 has an inlet which abuts closely adjacent fuel jet 14 to provide a substantially continuous fuel flow passageway for the fuel without the fuel impacting in or against pocket 28.

Fuel guide tube 30 includes a plurality of sets of spaced perforations or holes 40 along the length of body 34, e.g. fours sets of three holes 40 spaced approximately 90 around the periphery of fuel guide tube 30. Holes 40 in adjacent sets are longitudinally staggered relative to one another. Holes 40 allow some of the fuel flowing through fuel guide tube 30 to exit into the annular space 36 formed between fuel guide tube 30 and internal bore 18. Another portion of the fuel within fuel guide tube 30 simply passes out through the open free end of body 34 into internal bore 18 of discharge tube 12. Thus, guide tube 30 smoothly conducts fuel from fuel jet 14 into internal bore 18. For a guide tube having a diameter of 0.125 inches, Applicant has found holes 40 having a diameter of 0.026 inches to be satisfactory.

Figure 5:
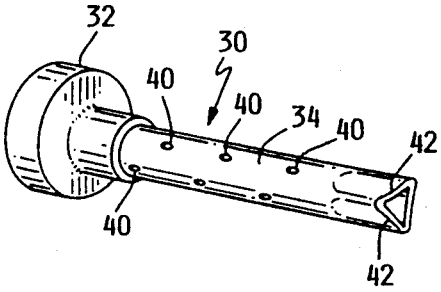
FIG. 5 is a perspective view of the fuel flow guide tube component of the improved fuel discharge assembly of the present invention as shown in FIG. 3.
Figure 4:
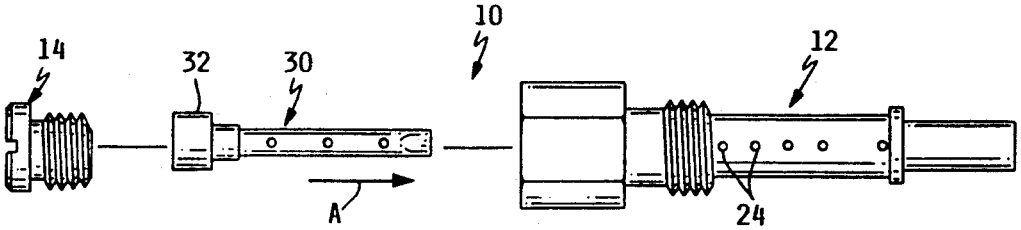
FIG. 4 is an exploded side elevational view of the improved fuel discharge assembly shown in FIG. 3.

Fuel guide tube 30 of the Applicant's invention is machined or made in any suitable fashion out of a metallic material of the same type used to make discharge tube 12 and fuel jet 14, e.g. brass or a similar metal. The outlet end of fuel guide tube 30 can be fluted as shown at 42 in FIG. 5 to avoid burrs or sharp edges on the end of tube 30. As illustrated herein, fuel guide tube 30 is made as an aftermarket part which can be inserted into the fuel discharge assemblies 10 previously known in the art. In this regard, with fuel jet 14 being first unscrewed from discharge tube 12, fuel guide tube 30 can simply be telescopically inserted into discharge tube 12 in the direction of the arrow A in FIG. 4. Fuel guide tube 30 is pushed in until the enlarged head 32 thereof seats against the closed end of threaded boss 16 with body 34 telescopically extending down into internal bore 18 of discharge tube 12. Fuel jet 14 may then be screwed back in until it is closely adjacent the enlarged head 32 of fuel guide tube 30 as shown in FIG. 3.

While fuel guide tube 30 has been shown as a separate aftermarket part which is retrofittable into an existing fuel discharge assembly 10, the invention is not limited to that construction. Instead discharge tube 12 could be formed with integral structure corresponding to fuel guide tube 30. Such an integral structure would also be covered by the present invention.

When fuel guide tube 30 is installed in fuel discharge assembly 10, the Applicant has noticed an appreciable increase in power delivered by the engine when fuel discharge assembly 10 is providing fuel to the airflow passage when compared to the power provided when fuel guide tube 30 is absent from discharge assembly 10. Applicant believes that this is a result of providing better and more complete fuel atomization while minimizing undesirable fuel turbulence. In other words, fuel guide tube 30 removes any turbulence in pocket 28 formed between fuel jet 14 and internal bore 18 in discharge tube 12 as that pocket 28 is no longer effectively present. In addition, fuel guide tube 30 smoothly conducts the fuel through pocket 28 and into internal bore 18 in the discharge tube.

The presence of holes 40 in fuel guide tube 30 appears to be preferred over a tube 30 which is solid and without the holes 40. Applicant believes that the presence of holes 40, which allows fuel to flow into the annular space between fuel flow guide tube 30 and the internal bore 18 of tube 12 as well as out the open discharge end of tube 30, helps break up the fuel somewhat after it has entered bore 18. This is believed to promote better and more complete atomization and mixing with the air passing into tube 12 through vent holes 24.

Various modifications of this invention will be apparent to those skilled in the art. Thus, the scope of the present invention is to be limited only by the appended claims.

I claim:

1. An improved carburetor for use on an internal combustion engine, the carburetor having an airflow passage and fuel discharge means for admitting fuel into the airflow passage for mixing the fuel with air flowing in the airflow passage to form a fuel/air mixture to be supplied to the combustion chamber(s) of the engine, the fuel discharge means including a fuel discharge assembly which comprises a hollow discharge tube and fuel supplying means connected to the discharge tube for admitting fuel into the interior of the discharge tube, wherein the discharge tube has a longitudinal internal bore in fluid communication with the fuel supplying means, wherein the internal bore extends between an inlet that is closest to the fuel supplying means and an outlet that is furthest from the fuel supplying means with the outlet of the bore being located within the airflow passage of the carburetor to supply fuel into this passage after the fuel passes from the fuel supplying means through the internal bore of the discharge tube, wherein the improvement relates to the fuel discharge assembly and comprises:

a hollow fuel flow guide tube telescopically received inside the internal bore of the discharge tube, wherein the fuel flow guide tube extends from approximately the location of the inlet of the bore up at least a portion of the length of the bore towards the outlet of the bore to conduct fuel from the fuel supplying means into the bore of the discharge tube.

2. A carburetor as recited in claim 1, wherein the fuel flow guide tube has a smaller diameter than an inside diameter of the internal bore to form an annular space therebetween.

3. A carburetor as recited in claim 2, wherein the fuel flow guide tube has a plurality of spaced holes over its length which allow fuel to flow from inside the guide tube into the annular space formed between the guide tube and the inside diameter of the internal bore.

4. A carburetor as recited in claim 3, wherein the fuel flow guide tube is open at both ends such that fuel also passes through the fuel flow guide tube and exits into the internal bore of the discharge tube through one of the open ends of the fuel flow guide tube.

5. A carburetor as recited in claim 3, further including a plurality of sets of holes in which the holes are spaced apart along the length of the fuel flow guide tube, and wherein the sets are circumferentially spaced apart around the circumference of the fuel flow guide tube.

6. A carburetor as recited in claim 5, wherein adjacent sets of holes are staggered longitudinally relative to one another along the length of the fuel flow guide tube.

7. A carburetor as recited in claim 5, wherein there are four such sets of holes circumferentially spaced apart 90° around the circumference of the fuel flow guide tube.

8. A carburetor as recited in claim 5, wherein the fuel flow guide tube has an outside diameter of 0.125 inches, and the holes have a diameter of approximately 0.026 inches.

9. A carburetor as recited in claim 1, wherein the fuel flow guide tube is open at both ends with one end being located closely adjacent the fuel supplying means and the other end being located within the internal bore of the discharge tube.

10. A carburetor as recited in claim 1, wherein the fuel supplying means comprises a fuel jet which is suited to be secured to one end of the discharge tube with the fuel jet being spaced from the inlet to the longitudinal bore of the discharge tube to form a pocket therebetween, and wherein the fuel flow guide tube is open at both ends with one end of the fuel flow guide tube extending out from the longitudinal bore of the discharge tube to be located in a substantially abutting relationship to the fuel jet to provide a substantially continuous fuel flow passageway from the fuel jet through the pocket and into the internal bore of the discharge tube.

11. A carburetor as recited in claim 10, wherein the one end of the fuel flow guide tube is formed as an enlarged head which is suited to have substantially the same shape as the pocket formed between the fuel jet and the internal bore of the discharge tube with the rest of the fuel flow guide tube comprising a cylindrical tube extending from the pocket and concentrically received within the internal bore of the discharge tube.

12. A carburetor as recited in claim 11, wherein the fuel flow guide tube has a smaller diameter than an inside diameter of the internal bore to form an annular space therebetween, and wherein the fuel flow guide tube has a plurality of spaced holes over its length which allow fuel to flow from inside the guide tube into the annular space formed between the guide tube and the inside diameter of the internal bore.

13. A carburetor as recited in claim 1, wherein the fuel flow guide tube extends over approximately at least 50% of the length of the internal bore.

14. A carburetor as recited in claim 1, wherein the fuel discharge assembly is operative only during engine operating conditions requiring high power, the carburetor having other fuel discharge means for supplying fuel to the airflow passage during idling or cruising conditions of the engine.

15. An improved fuel discharge assembly suited for supplying fuel to the airflow passage of a carburetor adapted to be secured to an internal combustion engine, which comprises:

an elongated discharge tube having an enlarged boss at one end and a free outer end which is suited to be located in the airflow passage, the tube having an internal bore which extends between an inlet to the bore located adjacent the boss and an outlet of the bore at the free outer end of the tube;

(b) a fuel jet which may be secured to the enlarged boss of the tube for supplying fuel to the internal bore of the discharge tube, the fuel jet when installed in the boss being spaced from the inlet of the bore by a cylindrical pocket which is larger in diameter than the diameter of the bore; and (c) an internal fuel flow guide tube which is inserted into the discharge tube, at both ends and comprising:

(i) a cylindrical body that extends from the inlet of the bore down at least a portion of the bore and is concentrically received in the bore; and (ii) an enlarge head shaped to substantially fill in the pocket such that the head is closely adjacent the fuel jet, whereby the fuel flow guide tube provides a substantially continuous fuel flow passageway from the fuel jet to the internal bore of the discharge tube such that fuel is not first discharged into the pocket before entering the discharge tube.

16. A fuel discharge assembly as recited in claim 15, wherein the fuel flow guide tube has a smaller diameter than an inside diameter of the internal bore to form an annular space therebetween, and wherein the fuel flow guide tube has a plurality of spaced holes over its length which allow fuel to also flow from inside the guide tube into the annular space formed between the guide tube and the inside diameter of the internal bore.

17. An improved fuel discharge assembly suited for supplying fuel to the airflow passage of a carburetor adapted to be secured to an internal combustion engine, which comprises:

(a) a discharge tube having a first end and a second end which is suited to be located in the airflow passage, the discharge tube having an internal bore which extends between an inlet to the bore located adjacent the first end of the discharge tube and an outlet of the bore at the second end of the discharge tube, wherein the discharge tube is perforated to allow air to mix with the fuel flowing in the discharge tube;

(b) means carried at the first end of the discharge tube for supplying fuel to the internal bore of the discharge tube; and (c) an internal fuel flow guide tube which is concentrically inserted into the discharge tube and extends over at least a portion of the length of the discharge tube, wherein the fuel flow guide tube is hollow and has a smaller diameter than an inside diameter of the internal bore to form an annular space therebetween, and wherein the fuel flow guide tube is perforated over at least a portion of its length to allow fuel flowing through the discharge tube to flow from inside the fuel flow guide tube into the annular space formed between the fuel flow guide tube and the inside diameter of the internal bore.

18. A fuel discharge assembly as recited in claim 17, wherein the fuel flow guide tube has a first end thereof located adjacent the fuel supplying means to help conduct the fuel being supplied to the discharge tube into the discharge tube.

19. A fuel discharge assembly as recited in claim 18, wherein a second end of the fuel flow guide tube opposite the first end is open to allow some fuel to pass all the way through the fuel flow guide tube and out the open second end of the fuel flow guide tube as well as passing out through the perforation(s) in the fuel flow guide tube.

20. A fuel discharge assembly as recited in claim 19, wherein the fuel flow guide tube is shorter than the length of the internal bore of the discharge tube such that the open second end of the fuel flow guide tube is located within the internal bore of the discharge tube.

* * * * *